US006042755A

United States Patent [19]

Matsumoto

[11] Patent Number: 6,042,755

[45] Date of Patent: Mar. 28, 2000

[54] HEATING FURNACE FOR A DEVICE FOR DRAWING A PLASTIC OPTICAL FIBER

[75] Inventor: Shinichi Matsumoto, Yokkaichi, Japan

[73] Assignee: Sumitomo Wiring Systems, Ltd., Yokkaichi, Japan

[21] Appl. No.: 09/146,314

[22] Filed: Sep. 3, 1998

[30] Foreign Application Priority Data

Sep. 11, 1997 [JP] Japan ..... 9-246789

[51] Int. Cl.[7] ..... B29D 11/00

[52] U.S. Cl. ..... 264/1.24; 264/1.29; 264/DIG. 65; 425/143; 425/DIG. 39

[58] Field of Search ..... 264/1.1, 1.24, 264/1.28, 1.29, 2.7, DIG. 65; 425/143, 378.1, DIG. 39; 432/128, 163

[56] References Cited

U.S. PATENT DOCUMENTS 4,571,313 2/1986 Allemand et al. ..... 264/1.29
5,614,253 3/1997 Nonaka et al. .
5,639,512 6/1997 Nonaka et al. .

FOREIGN PATENT DOCUMENTS 7-234322 9/1995 Japan .
7-234323 9/1995 Japan .
7-234324 9/1995 Japan .
7-234325 9/1995 Japan .
7-287132 10/1995 Japan .

OTHER PUBLICATIONS

English Language Abstract of JP No. 7–234322.
English Language Abstract of JP No. 7–234323.
English Language Abstract of JP No. 7–234324.
English Language Abstract of JP No. 7–234325.
English Language Abstract of JP No. 7–287132.

*Primary Examiner*—Mathieu D. Vargot
*Attorney, Agent, or Firm*—Greenblum & Bernstein, P.L.C.

[57] ABSTRACT

A heating furnace is used in a drawing device for drawing a base material made of plastic. The base material is fed into the heating furnace, melted under heat and drawn into a plastic optical fiber. The heating furnace is divided into a pre-heating zone located upstream and a heat-melting zone located downstream in the advancing direction of the base material and of the plastic optical fiber made therefrom. The preheating zone includes a pre-heater for pre-heating the base material, while the heat-melting zone includes a melting heater for melting the base material. Both zones are controllable independently so as to give an appropriate temperature for each zone.

20 Claims, 4 Drawing Sheets

FIG.4A 31,33
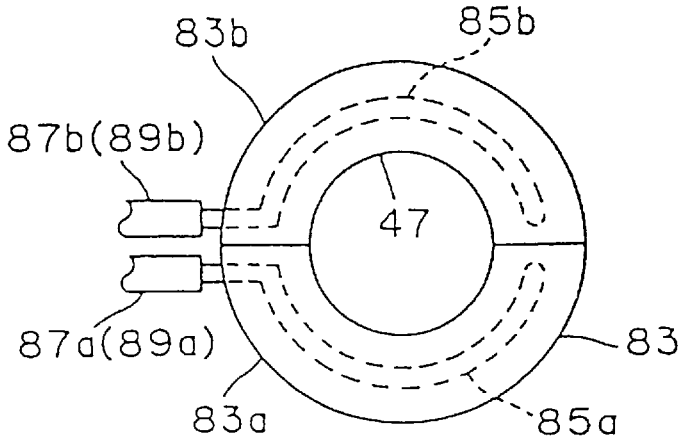
FIG.4B 31,33
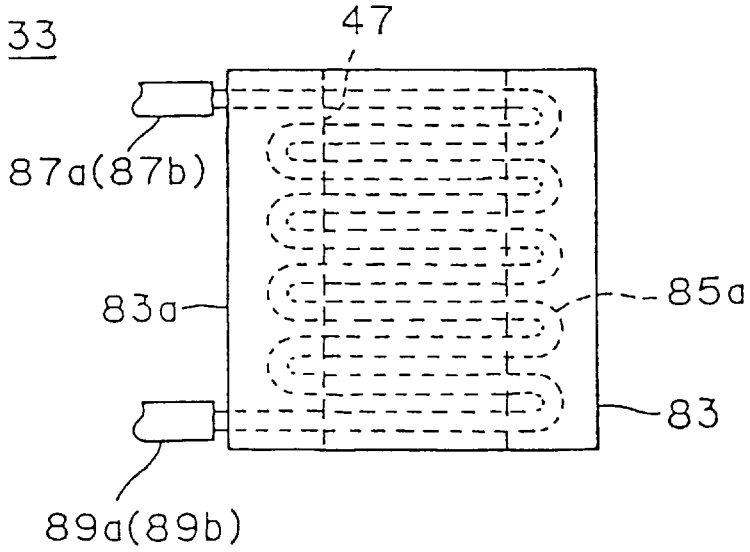

HEATING FURNACE FOR A DEVICE FOR DRAWING A PLASTIC OPTICAL FIBER

BACKGROUND OF THE INVENTION

1. Field of the Invention

The present invention relates to a heating furnace used in plastic optical fiber drawing devices.

2. Description of the Prior Art

FIG. 1 is a cross-sectional view of a plastic optical fiber drawing device using a prior art heating furnace. The drawing device is provided with a heating furnace 3 which first heats and melts a base material 1 and draws it into a fiber. The device is also provided with a base-material feeding device 5 which supplies the base material 1 into the heating furnace 3. The device further comprises a coiler 9 which reels the plastic optical fiber 7 made from the base material 1. Inside the heating furnace 3, there is provided a single cylindrical radiant heater 11 for heating and melting the base material 1.

The heater 11 has a length L of 60 mm, when measured in the drawing direction of the plastic optical fiber 7. The heater 11 supplies heat to the base material 1. The amount of heat supplied is related to the time required for passing the base material 1 through the heater 11, i.e., to the length L of the heater 11 and the feeding speed for the base material 1 (drawing line-speed). The drawing line-speed is limited by the length L of the heater 11. For example, with a heater 11 having a length of 60 mm, the drawing line-speed is limited to 5 m/min. When the speed is above this value, the heat transfer to the base material 1 is slowed down and the base material 1 is drawn in a half-melt state, so that the fiber may be cut off.

Usually when drawing plastic base material 1, a line speed of 10 m/min is considered to be a feasible criterion. In the drawing devices using a known heating furnace 3, the amount of heat provided by the heater 11 to the base material 1 is not sufficient. As a result, a line speed of only 5 m/min can be obtained, which raises a feasibility problem.

A method for enhancing the line speed may include increasing the length L of the heater 11. However, when only the heater 11 is lengthened, temperature variations become greater along the longitudinal direction of the heater 11. Consequently, the melt zone (neck-down zone) of the base material 1 forms an unstable shape. The external diameter of the plastic optical fiber 7 thus becomes less accurate.

For instance, when length L of the heater 11 is doubled to 120 mm and the line speed attains 10 m/min, the temperature variations along the heater 11 increase from ±10° C. to ±20° C. Consequently, the variations in the outer diameter of the plastic optical fiber 7 increase from ±30 $\mu$m to ±50 $\mu$m.

In view of this problem, an object of the present invention is to provide a heating furnace used in a drawing device for a plastic optical fiber, by virtue of which the drawing line-speed can be improved, without deteriorating the dimension accuracy of the resulting optical fiber.

SUMMARY OF THE INVENTION

Thus, according to one aspect of the present invention, a heating furnace is provided in a drawing device for drawing a base material made of plastic. The base material is fed into the heating furnace, melted under heat and drawn into a plastic optical fiber. The heating furnace is divided into a pre-heating zone located upstream and a heat-melting zone located downstream along the advancing direction of the base material and of the plastic optical fiber made therefrom.

The pre-heating zone includes a pre-heater for pre-heating the base material, while the heat-melting zone includes a melting heater for melting the base material under heating, each of the zones being independently controllable so as to give an appropriate temperature in each zone.

Unlike the prior art, when using the heating furnace according to the present invention, lengthening the melting heater, which incurs longitudinal temperature variations, is no longer required. Unit heat transfer to the base material can thus be increased. As a result, even if the feed speed of the base material is increased in order to increase the drawing line-speed, this does not slow down the heat transfer to the base material. This in turn prevents the plastic optical fiber from cutting-off and the deterioration of the dimension accuracy due to temperature fluctuations. The drawing line-speed is thus increased and the productivity improved.

The heaters can also be controlled easily, without being affected by each other. This also allows minimizing longitudinal temperature variations and producing a plastic optical fiber of highly accurate diameter.

Advantageously, the pre-heater and the melting heater include a heat-conducting element having a cylindrical hole through which the base material is passed and a heat-emitting element embedded in the heat-conducting element, such that it substantially surrounds the cylindrical hole.

Preferably, the heat-emitting element is an electric wire helically surrounding the cylindrical hole.

There is thus no soot generated, unlike the case of a carbon heater. Any special equipment for excluding soot, such as a protecting tube, is therefore not required. Moreover, the heater of the present invention has a longer life span than the carbon heater. Replacement frequency is thus reduced so that the cost is lowered and the productivity is improved.

The heat-conducting element and the heat-emitting element embedded therein may include of a pair of substantially symmetrical parts, such that, when they are combined, they form the cylindrical hole, and the heat-emitting element substantially surrounds the cylindrical hole.

Advantageously, the heating furnace includes an upstream wall and a downstream wall across the advancing direction of the base material and is divided into the pre-heating zone and the heat-melting zone by an insulating partition. Each of the upstream wall, downstream wall, and insulating partition has an opening at a position corresponding to that of the cylindrical hole.

The heat-melting zone may include a heat-homogenizing tube extending through the melting zone in the advancing direction of the plastic optical fiber and through the downstream wall.

Preferably, the openings of the upstream wall and the insulating partition are respectively equipped with a cap having a hole, the diameter of which is slightly greater than that of the base material.

According to one aspect of the present invention there is provided a heating furnace for use in a drawing device for drawing a base material made of plastic, where the base material is fed into the heating furnace, melted under heat, and drawn into a plastic optical fiber. The heating furnace includes a pre-heating zone, located upstream, that includes a pre-heater for pre-heating the base material and a heat-melting zone, located downstream in the advancing direction of the base material and of the plastic optical fiber made therefrom. The heat-melting zone includes a melting heater for melting the base material. The pre-heating zone and the heat-melting zone are controllable independently so as to allow an appropriate temperature for each zone.

According to another aspect of the present invention, each of the pre-heater and the melting heater further includes a heat-conducting element having a cylindrical hole through which the base material passes. The heat-conducting element includes a heat-emitting element embedded therein and substantially surrounding the cylindrical hole.

According to another aspect of the present invention, the heat-emitting element includes an electric wire helically surrounding the cylindrical hole.

According to an additional aspect of the present invention, the heat-conducting element and the heat-emitting element embedded therein include a pair of substantially symmetrical parts, such that when the pair of parts are combined, they form the cylindrical hole where said heat-emitting element substantially surrounds said cylindrical hole.

According to a further aspect of the present invention, the heating firnace further includes an upstream wall and a downstream wall extending generally traverse to the advancing direction of the base material and of the plastic optical fiber made therefrom. The furnace being divided into the pre-heating zone and the heat-melting zone by an insulating partition, wherein each of the upstream wall, the downstrearn wall, and the insulating partition has an opening at a position corresponding to that of the cylindrical hole.

According to another aspect of the present invention, the heat-melting zone further comprises a heat-homogenizing tube extending through the melting zone, in the advancing direction of the plastic optical fiber, and through the opening in the downstream wall.

According to another aspect of the present invention, the openings of the upstream wall and the insulating partition are respectively equipped with a cap having a hole, the diameter of the hole being slightly greater than that of the base material.

According to an additional aspect of the present invention there is provided a method for enhancing the drawing line speed of a furnace used in a drawing device for drawing a base material into an optical fiber, the method including: feeding a base material into a pre-heating zone of the furnace, the pre-heating zone including a preheater for pre-heating the base material; setting the temperature in the pre-heating zone to be lower than the transition temperature of the base material; heating the base material to a predetermined temperature inside the pre-heating zone; passing the base material from the pre-heating zone to a heat-melting zone, the heat-melting zone including a melting heater for melting the base material; setting the temperature in the heat-melting zone to be higher than the transition temperature of the base material so as to melt it; and melting the base material in the heat melting zone while simultaneously drawing the base material into an optical fiber, whereby the drawing line speed of the furnace can be increased without slowing down the heat transfer to the base material, cutting off the optical fiber, or deteriorating the accuracy of the diameter of the optical fiber.

According to another aspect of the present invention, the method further includes insulating the preheating zone from the heat melting zone using an insulating partition, the insulating partition having an opening slightly greater than the base material to allow passing of the base material from the pre-heating zone to the heat-melting zone.

According to another aspect of the present invention, the method further includes homogenizing the heat inside the heat-melting zone, the homogenizing minimizing temperature variations inside the heat-melting zone, thereby allowing increased unit heat transfer to the base unit.

BRIEF DESCRIPTION OF THE DRAWINGS

The above and other objects, features and advantages of the present invention will become apparent from the following description of the preferred embodiments, given as non-limiting examples, with references to the accompanying drawings, in which:

FIG. 4A shows a top plan view of a second embodiment of the pre-heater and melting heater shown in FIGS. 3A and 3B; and FIG. 4B is a side plan view of the second embodiment of the pre-heater and melting heater shown in FIGS. 3A and 3B.

PREFERRED EMBODIMENTS OF THE INVENTION

Figure 1:
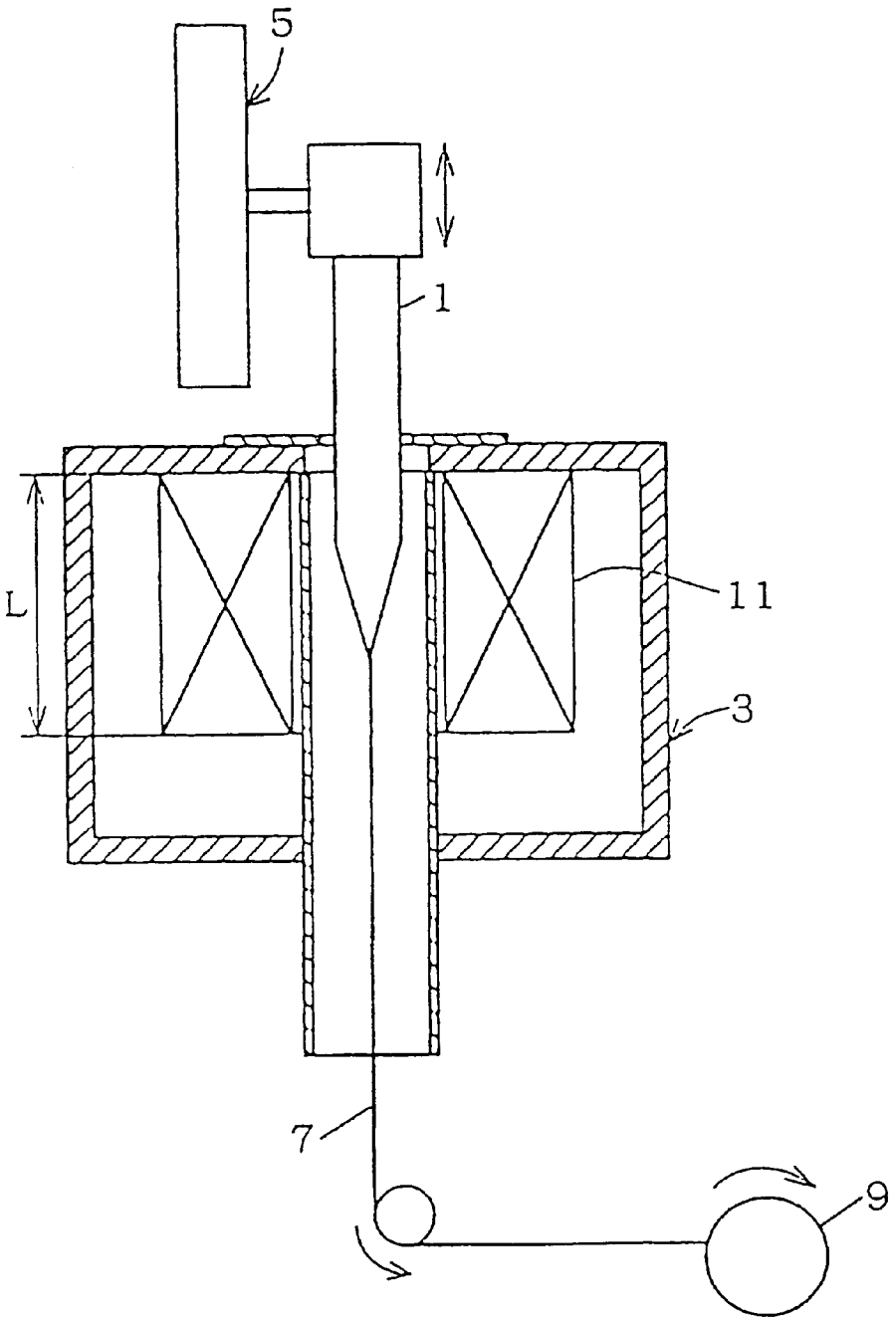
FIG.1 PRIOR ART
FIG. 1 is a cross-sectional view of a drawing device for plastic optical fiber, using a prior art heating furnace.
Figure 2:
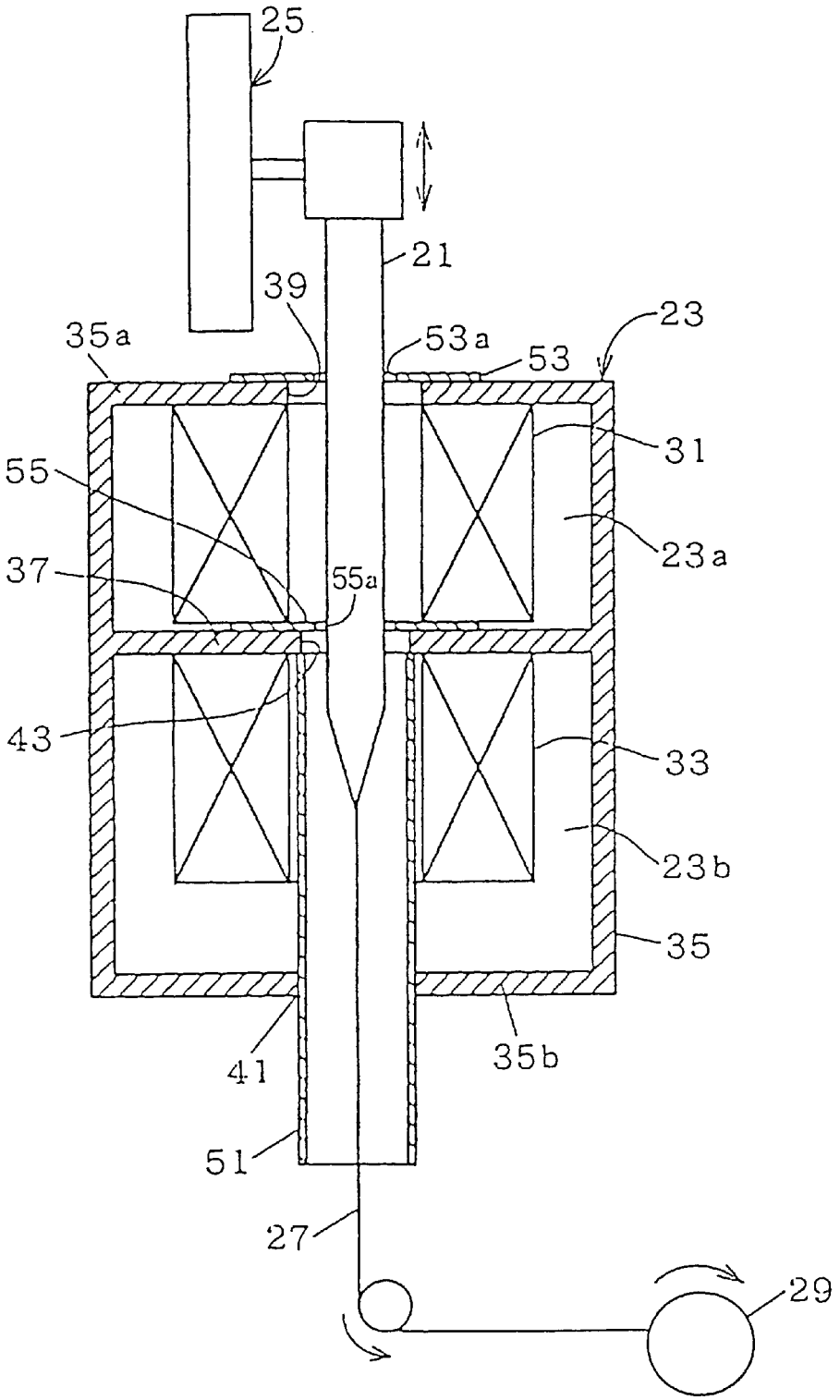
FIG. 2 shows a cross-sectional view of a drawing device for a plastic optical fiber, equipped with a heating furnace according to a first embodiment of the present invention.

FIG. 2 shows a cross-sectional view of a drawing device for a plastic-optical fiber, according to a first embodiment of the present invention, in which a heating furnace is used.

The drawing device includes of a heating furnace 23 for heating and melting a base material 21 and for drawing it into a fiber, a base material feeding device 25 for feeding the base material 21 into the heating furnace 23, and a coiler 29 for reeling the plastic optical fiber 27 made by drawing the base material 21. The base material 21 has a rod shape including a core part having a high refractive index and a cladding coated thereon having a lower refractive index.

The base material 21 is heated and melted in the heating furnace 23 and continuously drawn to form a plastic optical fiber 27.

The heating furnace 23 includes a pre-heater 31 (radiant heater), a melting heater 33 (radiant heater), and an insulating jacket 35 surrounding the heaters 31, 33.

The inside of jacket 35 is divided by an insulating partition 37 into an upstream and a downstream zone or chamber along the advancing direction of the base material 21 and of the plastic optical fiber 27 drawn out therefrom (from top to bottom in FIG. 2). The inside of jacket 35 thus includes a pre-heating zone 23*a* located upstream toward feeding device 25, and a heat-melting zone 23*b* located downstream, toward coiler 29. The pre-heating zone 23*a* houses pre-heater 31, and heat-melting zone 23*b* houses melting heater 33.

The jacket 35 has an upstream and a downstream wall 35*a*, 35*b*, respectively, and an insulating partition 37. The walls and partition are provided with openings 39, 43, 41 aligned respectively from upstream to downstream, for passing the base material 21 and the plastic optical fiber 27 therethrough.

Figure 3A:
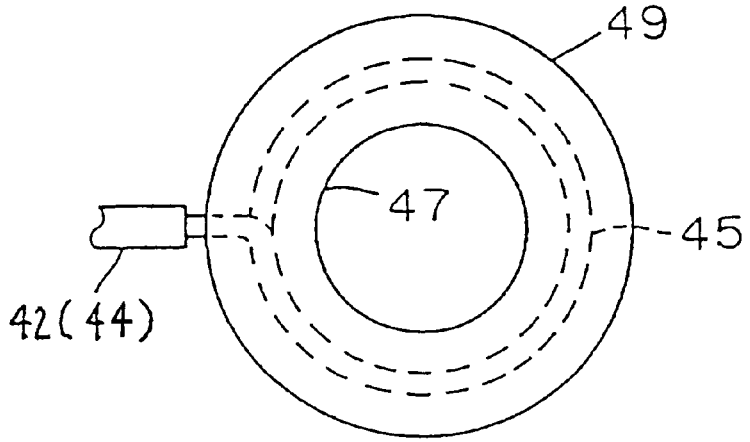
FIG. 3A shows a top plan view of the pre-heater and the melting heater of the heating furnace according to the first embodiment of the present invention.
Figure 3B:
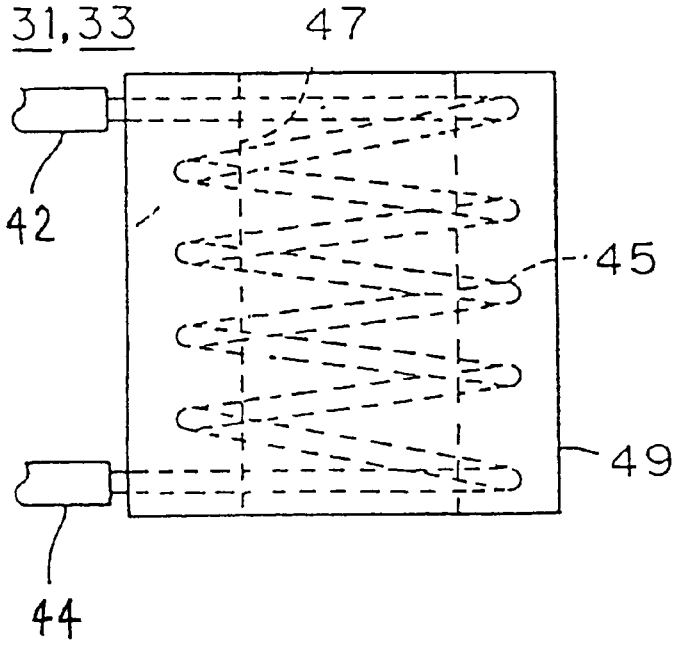
FIG. 3B is a side plan view of the pre-heater and the melting heater of the heating furnace according to the first embodiment of the present invention.

As shown in FIGS. 3A and 3B, pre-heater 31 and the melting heater 33 have the same structure. Electrodes 42, 44 are inserted into heating furnace 23 through the jacket 35. These electrodes 42, 44 are connected to an electric heating wire 45 (heat emitting element) formed form, for example, a nickel-chromium alloy. The electric heating wire 45 is embedded in a heat-conducting element 49 having a cylindrical shape and the latter is further provided with a through-hole 47 formed in the central zone thereof The electric heating wire 45 is coiled and embedded in heat-conducting element 49, such that it surrounds hole 47 and extends from top to bottom thereof (seen in FIG. 3B). By virtue of this configuration, heat-conducting element 49 is uniformly heated by electric heating wire 45. Further, heat-conducting material 49 is made of a metal, such as aluminum, having a high heat-transfer coefficient for efficiently conducting heat coming from electric heating wire 45. For this reason the peripheral zone of electric heating 45 is submitted to an electrical insulation treatment According to one embodiment of the present invention, aluminum is used for electric heating wire 45. However, another metal, such as copper or stainless steel, may be used. In heaters 31, 33, electric heating wire 45 is placed beforehand in a mold and fused aluminum is cast thereinto. The pre-heater 31 and melting heater 33 thus obtained have an electric capacity of 100 V/400 W.

The hole 47 of pre-heater 31 and melting heater 33 has a diameter approximately the same as that of the openings 39, 41, 43 in jacket 35 and insulating partition 37. The pre-heater 31 and the melting heater 33 are provided respectively in preheating zone 23*a* and in heat-melting zone 23*b* of heating furnace 23 such that hole 47 and openings 39, 41, 43 are placed on the same axis, and such that heaters 31, 33 are separated by insulating partition 37, thereby forming an upstream zone and a downstream zone.

The melting heater 33 includes an inner cylindrical portion containing a central glass tube 51 (shown in FIG. 2) extending from the top of the hole 47, near opening 43, to the bottom thereof, toward opening 41, and projecting outward through opening 41 of jacket 35. By virtue of central tube 51, heat is transferred more evenly from melting heater 33 to base material 21, such that base material 21 is heated uniformly from its peripheral zone.

Further, the inner circular surface of opening 41 is in close contact with the external surface of central tube 51, such that the inner heat of furnace 23 is prevented from leaking out.

As mentioned above, jacket 35 of heating furnace 23 has an opening 39 in the upstream wall 35*a*, and an opening 43 in the insulating partition 37, respectively. These openings 39, 43 are equipped with caps 53, 55 provided with a hole 53*a*, 55*a*, respectively, as shown in FIG. 2. Holes 53*a*, 55*a* are formed so as to have a diameter slightly greater than the external diameter of base material 21, so that when caps 53, 55 are positioned, the gap between base material 21 and the diameter of openings 39, 43 is closed. The cap 53 thus prevents the heat from leaking out of pre-heater 23*a*, whereas cap 55 ensures the insulation between the preheating zone 23*a* and the heat-melting zone 23*b*.

Therefore, heating furnace 23 is divided into a preheating zone 23*a* and a heat-melting zone 23*b* by insulating partition 37 and cap 55. Further, preheating zone 23*a* and heat-melting zone 23*b* are equipped with pre-heater 31 and melting heater 33 respectively. Therefore, the preheating zone and the heat-melting zone can be controlled independently so as to obtain appropriate temperature therein.

The pre-heating zone 23*a* is provided for preheating base material 21. The temperature therein is therefore set to be lower than the glass transition temperature of the base material 21, so as not to melt base material 21. On the other hand, the temperature inside heat-melting zone 23*b* is set to be higher than the glass transition temperature of base material 21, so as to melt it. The temperature variations along pre-heater 31 and along melting heater 33 (from the top to the bottom in FIG. 2) are set to be within about ±30° C. and about ±10° C., respectively.

The base material 21 is fed into heating furnace 23 by base-material feeding device 25, inserted into hole 47 of pre-heater 31, set up in preheating zone 23*a* of heating furnace 23. The base material 21 is then heated to a predetermined temperature by pre-heater 31 and passed through central tube 51 provided in the internal cylindrical surface of melting heater 33 located in heat-melting zone 23*b*. The base material 21 is thus melted under heating by the melt-heater 33, and, at the same time, drawn into a plastic optical fiber 27 by coiler 29.

According to the above-mentioned embodiment of the present invention, the inside of heating furnace 23 is divided into a preheating zone 23*a* and a heat-melting zone 23*b* by insulating partition 37, and cap 55, such that the temperature of each zone can be individually controlled. The preheating zone 23*a* and heat-melting zone 23*b* are respectively provided with a pre-heater 31 and a melting heater 33. Thus, base material 21 is first pre-heated in pre-heater 31 and then melted in melting heater 33. Consequently, unlike the prior art, lengthening of melting heater 33, which incurs longitudinal temperature variations, is no longer necessary. Unit heat transfer to the base material 21 can thus be increased.

As a result, even if the feed speed of base material 21 is increased in order to increase the drawing line-speed, this does not slow down the heat transfer to base material 21. This in turn avoids cutting-off of the plastic optical fiber 27 and deterioration of the diameter accuracy thereof due to the temperature fluctuations along the heaters 31, 33. The drawing line-speed can thus be increased and the productivity enhanced.

The pre-heater 31 and melting heater 33 are installed in preheating zone 23*a* and heat-melting zone 23*b*, respectively, each of which the temperature can be controlled independently. The heaters 31, 33 can thus be controlled easily, without being affected by the other. This also allows minimizing longitudinal temperature variations and producing a diametrically highly accurate plastic optical fiber.

Further, heaters 31,33 for the base material 21, used as pre-heater and melting heater, respectively, include an electric heating wire 45 embedded in a heat-conducting element 49 that may be made of aluminum. There is, therefore, no soot generated, unlike the case of a carbon heater. Any special equipment for excluding soot, such as a protection tube, is therefore not required.

Further, such heaters 31, 33 have a longer life span than a carbon heater. Replacement frequency is thus reduced, so that replacement cost is lowered and productivity improved.

When a plastic optical fiber 27 is drawn using the heating furnace 23 according to the above-mentioned embodiment, the drawing line-speed can be increased from 5 m/min to 10 m/min. Even with this increase in drawing line-speed, no cutting-off of the fiber occurs, and the plastic optical fiber 27 produced satisfies a required quality level, i.e., a diameter accuracy of about ±30 $\mu$m.

FIGS. 4A and 4B show another embodiment of pre-heater 31 and melting heater 33 provided in heating furnace 23 of the present invention.

According to this embodiment, the cylindrical heat conducting element 83, provided with a hole 47, is divided along the longitudinal direction thereof into two parts 83*a*, 83*b*, which are assembled to form a cylindrical heat conducting element 83. Each of these parts 83*a*, 83*b* is implanted with an electric heating wire 85*a*, 85*b*, respectively. The electric heating wires 85*a*, 85b extend inside the corresponding part 83*a*, 83*b* by traversing in the semicircular direction from one end to the other, then the other way round, while extending at the same time from top to bottom in the longitudinal direction as shown in FIG. 4B. The embedded electric heating wires 85*a*, 85*b* are led out at the upper and lower sides of each part 83*a*, 83*b*. The upper-side leads are connected to electrodes 87*a*, 87*b* and the lower-side leads to 89*a*, 89*b*.

The material of parts 83*a*, 83*b* and the electric heating wires 85*a*, 85*b* may be the same as that of corresponding heat-conducting element 49 and electric heating wire 45. The parts 83*a*, 83*b* may be formed by casting as in the case of the heatconducting element 49.

The present disclosure relates to subject matter contained in Japanese Patent Application No. HEI 9-246789 (filed on Sept. 11, 1997) which is herein incorporated by reference in its entirety.

The present invention has been illustrated using some embodiments. This invention is not limited by these, but is meant to cover these and all other applications or embodiments that are within the spirit and scope of the invention.

What is claimed:

1. A heating furnace for use in a drawing device for drawing a base material made of plastic, the base material being fed into said heating furnace, melted under heat and drawn into a plastic optical fiber, said heating furnace comprising:

a pre-heating zone located upstream, said pre-heating zone comprising a pre-heater for pre-heating the base material; and a heat-melting zone located downstream in the advancing direction of the base material and of the plastic optical fiber made therefrom, said heat-melting zone comprising a melting heater for melting the base material, wherein said furnace is configured such that said pre-heating zone and said heat-melting zone are insulated from one another and are controllable independently so as to allow an appropriate temperature for each zone.

2. A heating furnace according to claim 1, wherein each of said pre-heater and said melting heater further comprises a heat-conducting element having a cylindrical hole through which the base material passes, and said heat-conducting element includes a heat-emitting element embedded therein and substantially surrounding said cylindrical hole.

3. A heating furnace according to claim 2, wherein said heat-emitting element is an electric wire helically surrounding said cylindrical hole.

4. A heating furnace according to claim 2, wherein said heat-conducting element and said heat-emitting element embedded therein include a pair of substantially symmetrical parts, such that when the pair of parts are combined, they form said cylindrical hole where said heat-emitting element substantially surrounds said cylindrical hole.

5. A heating furnace according to claim 1, wherein said heating furnace further comprises an upstream wall and a downstream wall extending generally traverse to said advancing direction of the base material and of said plastic optical fiber made therefrom, said furnace divided into said pre-heating zone and said heat-melting zone by an insulating partition, wherein each of said upstream wall, said downstream wall, and said insulating partition has an opening at a position corresponding to that of said cylindrical hole.

6. A heating furnace according to claim 2, wherein said heating furnace further comprises an upstream wall and a downstream wall extending generally traverse to said advancing direction of the base material and of the plastic optical fiber made therefrom, said furnace divided into said pre-heating zone and said heat-melting zone by an insulating partition, where each of said upstream wall, said downstream wall, and said insulating partition has an opening at a position corresponding to that of said cylindrical hole.

7. A heating furnace according to claim 3, wherein said heating furnace further comprises an upstream wall and a downstream wall extending generally traverse to said advancing direction of the base material and of the plastic optical fiber made therefrom, said furnace divided into said pre-heating zone and said heat-melting zone by an insulating partition, wherein each of said upstream wall, said downstream wall, and said insulating partition has an opening at a position corresponding to that of said cylindrical hole.

8. A heating furnace according to claim 4, wherein said heating furnace further comprises an upstream wall and a downstream wall extending generally traverse to said advancing direction of the base material and of the plastic optical fiber made therefrom, said furnace divided into said pre-heating zone and said heat-melting zone by an insulating partition, wherein each of said upstream wall, said downstream wall, and said insulating partition has an opening at a position corresponding to that of said cylindrical hole.

9. A heating furnace according to claim 5, wherein said heat-melting zone further comprises a heat-homogenizing tube extending through said melting zone, in the advancing direction of the plastic optical fiber, and through said opening in said downstream wall.

10. A heating furnace according to claim 6, wherein said heat-melting zone further comprises a heat-homogenizing tube extending through said melting zone, in the advancing direction of the plastic optical fiber, and through said opening in said downstream wall.

11. A heating furnace according to claim 7, wherein said heat-melting zone further comprises a heat-homogenizing tube extending through said melting zone, in the advancing direction of the plastic optical fiber, and through said opening in said downstream wall.

12. A heating furnace according to claim 8, wherein said heat-melting zone further comprises a heat-homogenizing tube extending through said melting zone in the advancing direction of the plastic optical fiber and through said opening in said downstream wall.

13. A heating furnace according to claim 5, wherein said openings of said upstream wall and said insulating partition are respectively equipped with a cap having a hole, the diameter of said hole being slightly greater than that of the base material.

14. A heating furnace according to claim 6, wherein said openings of said upstream wall and said insulating partition are respectively equipped with a cap having a hole, the diameter of said hole being slightly greater than that of the base material.

15. A heating furnace according to claim 7, wherein said openings of said upstream wall and said insulating partition are respectively equipped with a cap having a hole, the diameter of said hole being slightly greater than that of the base material.

16. A heating furnace according to claim 8, wherein said openings of said upstream wall and said insulating partition are respectively equipped with a cap having a hole, the diameter of said hole being slightly greater than that of the base material.

17. A heating furnace according to claim 9, wherein said openings of said upstream wall and said insulating partition are respectively equipped with a cap having a hole, the diameter of said hole being slightly greater than that of the base material.

18. A method for enhancing the drawing line speed of a furnace used in a drawing device for drawing a base material into an optical fiber, said method comprising:

feeding a base material into a pre-heating zone of the furnace, said pre-heating zone including a pre-heater for pre-heating said base material;

setting the temperature in said pre-heating zone to be lower than the glass transition temperature of said base material;

heating said base material to a predetermined temperature inside said pre-heating zone;

passing said base material from said pre-heating zone to a heat-melting zone, said heat-melting zone including a melting heater for melting said base material;

insulating said pre-heating zone from said heat-melting zone;

setting the temperature in said heat-melting zone to be higher than the glass transition temperature of said base material so as to melt it; and melting said base material in said heat melting zone while simultaneously drawing said base material into an optical fiber, whereby the drawing line speed of the furnace can be increased without slowing down the heat transfer to the base material, cutting off the optical fiber, or deteriorating the accuracy of the diameter of the optical fiber.

19. The method according to claim 18, wherein said insulating said preheating zone from said heat melting zone comprises using an insulating partition between said pre-heating zone and said heat-melting zone, the insulating partition having an opening slightly greater than said base material to allow passing of said base material from said pre-heating zone to said heat-melting zone.

20. The method according to claim 19, further comprising homogenizing the heat inside said heat-melting zone, said homogenizing minimizing temperature variations inside said heat-melting zone, thereby allowing increased unit heat transfer to said base material.

* * * * *